US005106070A

United States Patent [19]

Reist

[11] Patent Number: 5,106,070

[45] Date of Patent: Apr. 21, 1992

[54] PROCESS AND APPARATUS FOR THE FURTHER PROCESSING OF STACKED, PREFERABLY FOLDED PRINTING PRODUCTS

[75] Inventor: Walter Reist, Hinwil, Switzerland

[73] Assignee: Ferag AG, Hinwil, Switzerland

[21] Appl. No.: 569,629

[22] Filed: Aug. 20, 1990

[30] Foreign Application Priority Data

Sep. 13, 1989 [CH] Switzerland ..... 03340/89

[51] Int. Cl.[5] ..... B65H 5/08

[52] U.S. Cl. ..... 271/12; 271/101; 271/225; 198/457

[58] Field of Search ..... 271/12, 99-101, 271/184, 185, 225; 198/457

[56] References Cited

U.S. PATENT DOCUMENTS

| | | | |
|---|---|---|---|
| 2,754,953 | 7/1956 | Groncy | 198/457 |
| 3,239,676 | 3/1966 | Pali . | |
| 4,127,262 | 11/1978 | Eberle et al. | 271/12 |
| 4,311,230 | 1/1982 | Crawford et al. | 198/457 |
| 4,456,242 | 6/1984 | Morin | 271/225 |
| 4,572,350 | 2/1986 | Besemann | 198/457 |
| 4,986,730 | 1/1991 | Wetter | 198/457 |

FOREIGN PATENT DOCUMENTS

| | | | |
|---|---|---|---|
| 295382 | 7/1915 | Fed. Rep. of Germany | 198/457 |
| 590480 | 8/1932 | Fed. Rep. of Germany . | |
| 598106 | 7/1976 | Switzerland . | |
| 637087 | 3/1979 | Switzerland . | |
| 484093 | 12/1975 | U.S.S.R. | 271/225 |
| 829518 | 3/1960 | United Kingdom . | |

OTHER PUBLICATIONS

Ferag Instruction Manual; "High-Speed Hopper RA"; cover sheet and 27 pages (no date).

*Primary Examiner*—Joseph E. Valenza
*Assistant Examiner*—Steven M. Reiss
*Attorney, Agent, or Firm*—Bell, Seltzer, Park & Gibson

[57] ABSTRACT

A right parallelepipedal stack space (12) for receiving a stack of folded printing products (14) is arranged above a stack rest (1), which is formed by dividing rollers (2) driven in a circulating manner. The stack space (12) is slanted with one corner (12*a*) facing against the direction of movement (A) of the dividing rollers (2). In the region of this corner (12*a*) of the stack space (12), there is arranged a suction member (18) which can enter periodically between two neighboring dividing rollers (2) for taking up and drawing through the corner of the respectively lowermost printing product (14). The printing products (14) detached from the stack by the dividing rollers (2) moved along the stack base area are laid onto a removal conveyor (24) lying one above the other in the manner of roof tiles. The stack space (12) is slanted with another corner (12*b*) facing in conveying direction (C) of the removal conveyor (24) in such a way that an imbricated formation (S) in which the printing products (14) are arranged with one corner (25) leading is formed on the removal conveyor (24). At the sides of the imbricated formation (S) two corners (26, 27) of each printing product (14) lie free, at which individual printing products (14''') can be taken up and for example drawn laterally out.

11 Claims, 3 Drawing Sheets

A
14
14'
14"
14a
14b
14c
13
13a
2
5
6
7
8
9
18
19
20
21
22
23
24
27
H
S
C

PROCESS AND APPARATUS FOR THE FURTHER PROCESSING OF STACKED, PREFERABLY FOLDED PRINTING PRODUCTS

The present invention relates to a process and an apparatus for the further processing of stacked, preferably folded printing products.

Swiss Patent Specification 598,106 and the corresponding U.S. Pat. No. 4,127,262 disclose an apparatus for the further processing of stacked printing products of this type. In the case of that apparatus, the lowermost printing product in the stack is in each case taken up in the region of a corner by means of a suction head and drawn through between two dividing rollers, which are moved along the base area of the stack and form part of a stack rest. The lowermost printing product is detached from the stack by the dividing roller entering between the lowermost printing product and the printing product lying above and drops onto a removal conveyor, which is arranged underneath the stack. In this case, the stack is aligned in such a way that two of its side edges are at right angles to the conveying direction of the removal conveyor. The printing products detached in this way are led away by the removal conveyor in an imbricated formation in which the printing products lie one above the other in the manner or roof tiles and run with their leading edges at right angles to the conveying direction of the removal conveyor.

In practice, it has been found with this apparatus that the stack has to be swiveled by an angle of a few degrees with respect to the conveying direction of the removal conveyor in order to form on the removal conveyor the desired imbricated formation in which, as already mentioned, the printing products run with the leading edge at right angles to the conveying direction of the removal conveyor. This slight slanting of the stack is necessary because the dividing of the printing products is commenced at one corner of the same and the detaching of the printing products is continued in a direction which runs transversely to the conveying direction of the removal conveyor, which means that the individual regions of the detached printing products come to rest successively on the removal conveyor. Such apparatuses with a stack slanted slightly with respect to the conveying direction of the removal conveyor are sold by the company Ferag AG under the name "Schnellanleger RA" (High-Speed Hopper RA).

The apparatuses described above have the advantage of a high take-down rate, but suffer from the disadvantage that the access to the individual printing products in the combined imbricated formation for the purpose of individual processing of the printing products entails a certain complexity.

In addition, an apparatus of a similar type is known (Swiss Patent Specification 637,087) which is however of a slightly different design and with which the stack is slanted neither with respect to the direction of movement of the dividing rollers forming the stack rest nor with respect to the conveying direction of the removal conveyor.

Furthermore, British Patent Specification 829,518 discloses an apparatus for drawing off the respectively lowermost sheet from a stack, in which the lowermost stack is taken up by a suction head and drawn downward into the active range of two draw-off rollers. The stack of sheets is slanted with respect to the drawing-off direction of the rollers such that the sheets are transported away by the draw-off rollers with the edge previously taken up by the suction head in front. The sheets are drawn off and led away individually and successively, as a result of which the take-down rate is less than with the known apparatuses mentioned above.

The present invention is now based on the object of providing a process and an apparatus of the type mentioned at the beginning, which process and which apparatus allows, at a high rate, an easier processing and handling of individual printing products in the combined imbricated formation led away than is possible with the known apparatuses described at the beginning.

The above and other objects and advantages of the present invention are achieved by the provision of a method and apparatus wherein the stack of printing products rests upon a stack rest or support, which is composed of a plurality of parallel dividing rollers. The lowermost printing product in the stack is engaged in the region of a corner so that the corner region is moved downwardly and detached from the stack by the movement of a dividing element between the overlying printing products and which moves in a direction transversely to the side edges of the stack. The successively detached printing products are deposited in overlapping relation, onto a removal conveyor positioned beneath the stack and below the stack rest, and they are carried away by the removal conveyor in an imbricated formation. Also, the printing products are laid such that all of the side edges run transversely to the conveying direction of the removal conveyor, and onto the previously detached printing product with one corner leading.

Due to the fact that the printing products continue as before to be laid onto the removal conveyor with mutual overlapping but in such a way that all of the side edges of the printing products run transversely to the conveying direction of the removal conveyor and one corner faces in the direction of the conveying-away direction, on the one hand a satisfactory conveying-away of the printing products detached in quick succession from the stack is ensured and on the other hand an easy access to the individual printing products is possible. In the imbricated formation led away, the regions of two corners of each printing product as well as certain regions of side edges namely lie completely free. This allows a trouble-free engaging of the individual printing products.

Preferred developments of the process according to the invention and of the apparatus according to the invention form the subject of the dependent claims.

Illustrative embodiments of the subject of the invention are explained below in more detail with reference to the drawing, in which purely schematically:

Figure 1:
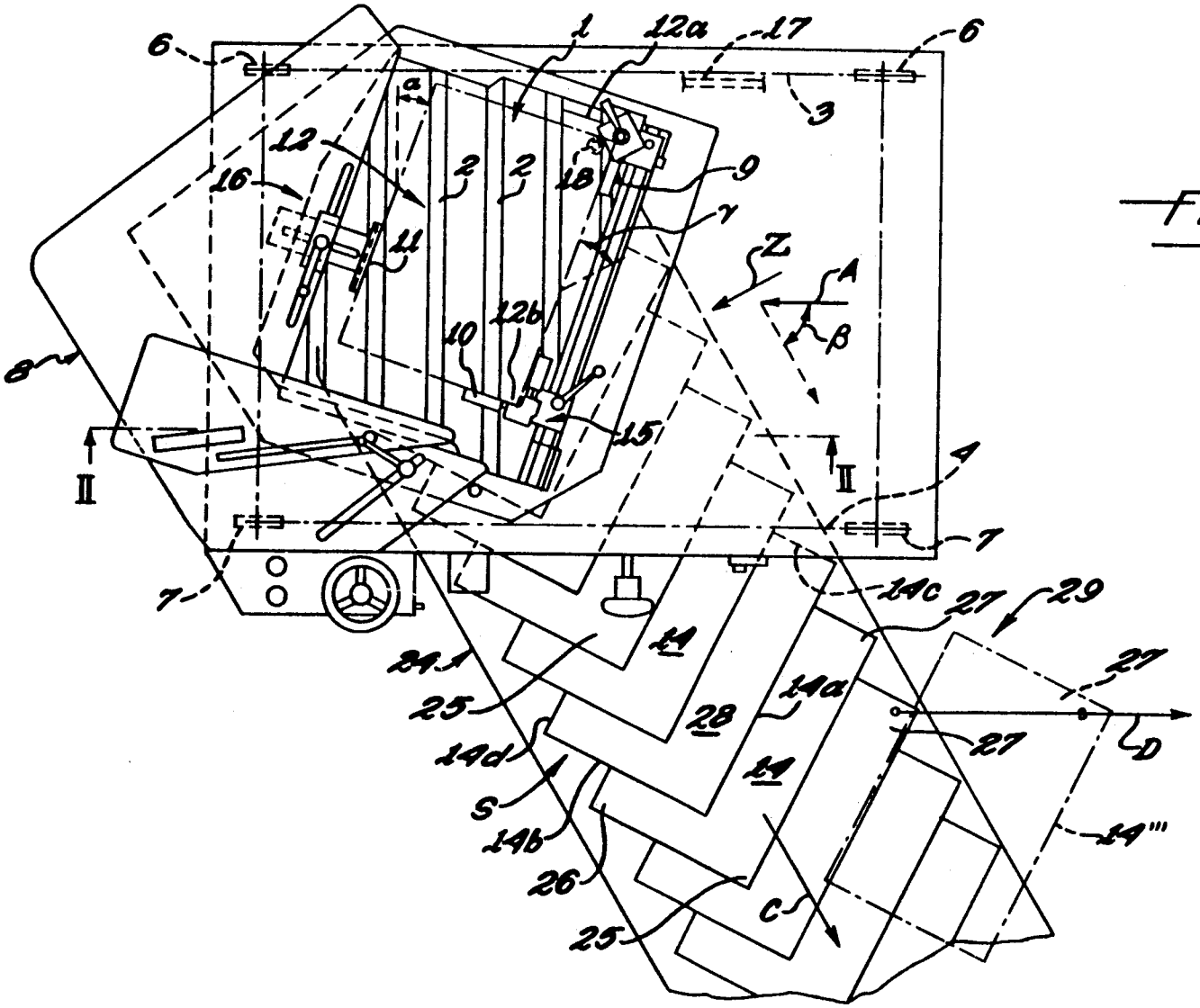
FIG. 1 shows an apparatus for the further processing of printing products in plan view.

The apparatus represented in the figures has a stack rest 1, which is formed by mutually parallel dividing rollers 2, arranged at intervals from one another. The rollers 2 are fastened at their ends to a chain 3 and 4, respectively, which runs in a chain channel 5, (see FIG. 2). The endless chains 3, 4 are led around deflection pulleys 6 and 7, respectively, of which one deflection pulley is driven in a way not shown. The dividing rollers 2 are thus driven in a circulating manner along a closed circulating path in the direction of the arrow A.

Above the stack rest 1 there is a stack table 8 with stops 9, 10, 11, of which the stops 9 and 10 are designed as corner stops. These stops 9, 10, 11 define a right parallelepipedal stack space 12 (FIG. 1), which is slanted with one corner 12*a* facing against the direction of movement A of the dividing rollers 2. This slanting of the stack space 12 is represented by the angle $\alpha$ in FIG. 1. This angle $\alpha$ is about 20°. The stack space 12 serves for receiving a stack 13 of folded printing products 14, for example newspapers, periodicals and parts thereof (FIG. 2). In the figures, the folded edge of these printing products 14 is denoted by 14*a*, while their side edges are denoted by 14*b* and 14*c* and their open side is denoted by 14*d*. The corner stop 9 is fixed, while the stops 10 and 11 can be adjusted by means of an adjusting mechanism 15 and 16, respectively, in order to adapt the size of the stack space 12 to the format of the printing product 14 respectively to be processed.

The dividing rollers 2 move during their circulation in the direction of the arrow A along the base area 13*a* of the stack 13 (FIG. 2) and roll on the respectively lowermost printing product 14 in the stack 13. The direction of rotation of the dividing rollers 2 is denoted in FIG. 2 by the arrow B. In this case, it is necessary that the circumferential speed of the dividing rollers 2 corresponds to their speed of advancement. In order to achieve this, adjacent to a chain there is provided a friction bar, which is represented only schematically in FIG. 1 and is denoted by 17. The dividing rollers 2 roll with their conically designed end on this friction bar 17, which can be adjusted, in a way not shown in more detail, at right angles to the direction of movement A of the dividing rollers 2.

Underneath the corner 12*a*, defined by the corner stop 9, of the stack space 12 there is a suction head 18, which is fastened to the one end of an angle lever 19 (FIG. 2). This angle lever 19 is guided at the other end by means of a roller 20 in a guide rail 21. The angle lever 19 is furthermore connected by means of a joint 22 to a planetary gearing 23. The construction of the drive for the suction head 18 and the path of movement of the latter produced as a result are described in more detail in the already previously mentioned Swiss Patent Specification 589,106 (or the corresponding U.S. Pat. No. 4,127,262). The suction head 18 can, furthermore, be connected periodically to a vacuum source (not shown in any more detail).

The suction head 18 enters periodically between, in each case, two adjacent dividing rollers 2, takes up a corner 27 of the lowermost printing product 14' and draws this corner 27 through between successive driving rollers 2, as shown in FIG. 2. The lowermost printing product 14' is detached from the stack 13 by the dividing roller 2 entering the opening between the lowermost printing product 14' and the printing product 14" lying above. The suction head 18 is disconnected from the vacuum source at a given time and once again moves upward through the intermediate space between the two following dividing rollers 2, in order to take up the next printing product 14", as is described in more detail in the mentioned Swiss Patent Specification 598,106 and the corresponding U.S. Pat. No. 4,127,262. The less pronounced slanting of the stack 13 in comparison with the already known apparatus, as shown and described in the cited patent specifications ($\alpha$=about 20° in comparison with about 45° in the case of the known apparatus), facilitates the bending away of the corner 27 taken up by the suction head 18, and thus of the folded edge 14*a*, in particular in the case of thick printing products 14.

Figures 2, 4:
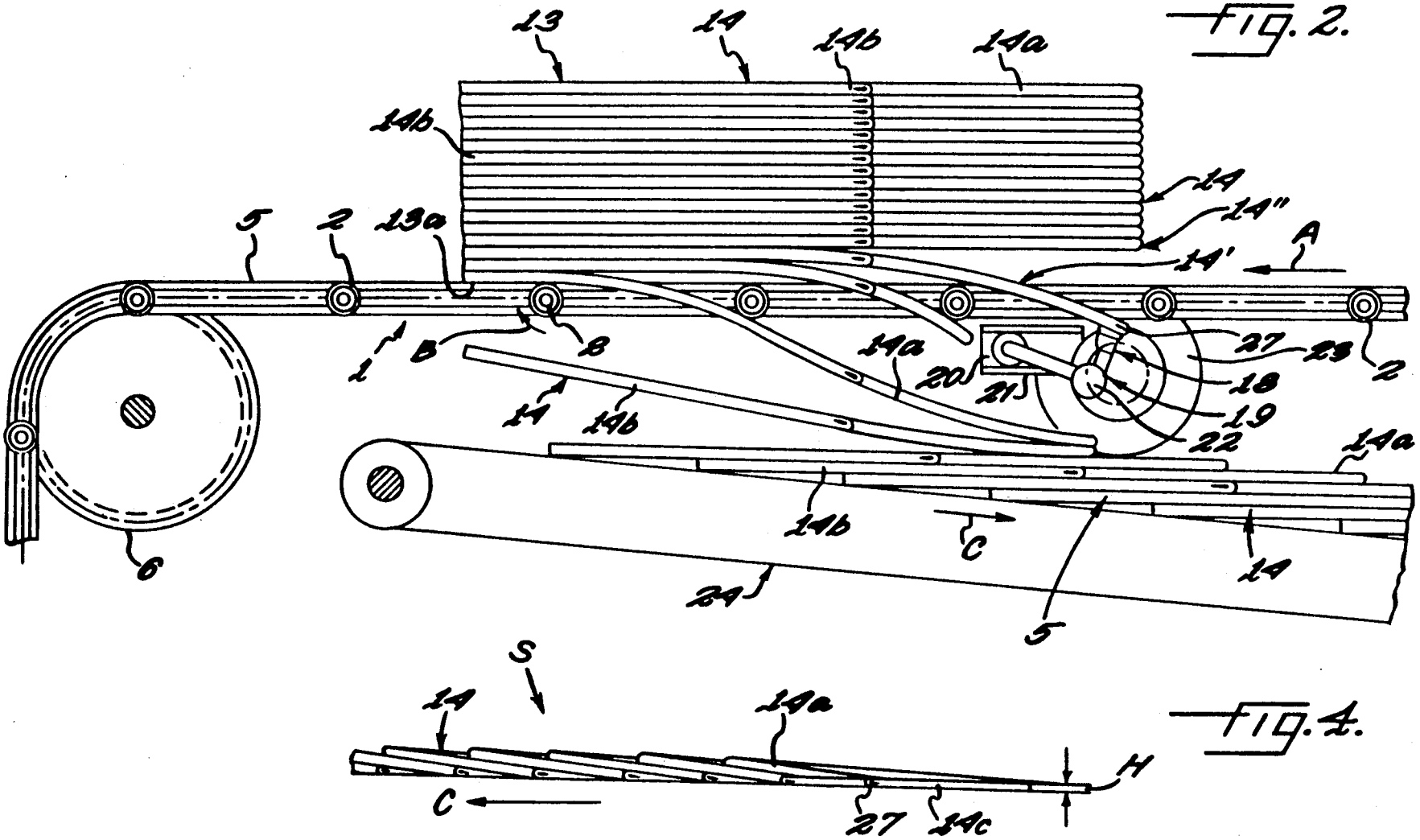
FIG. 2 shows a section along the line II—II in FIG. 1, but with certain parts of the apparatus omitted.
FIG. 4 shows the imbricated formation formed on the removal conveyor in side view in the direction of the arrow Z in FIG. 1.

A removal conveyor 24, the conveying direction C of which forms an angle $\alpha$ with the direction of movement A of the dividing rollers 2 is arranged reaching underneath the stack rest 1 and the stack space 12 (FIG. 1). The stack space 12 is in fact slanted by an angle Y with one of its corners 12*b* facing in conveying direction C of the removal conveyor 24 (FIG. 1) in such a way that the printing products 14 detached from the stack 13 are laid, with all of the side edges 14*a*, 14*b*, 14*c* and 14*d* running transversely to the conveying direction C of the removal conveyor 24, onto this removal conveyor 24 or in the manner of roof tiles onto the previously detached printing product 14, as clearly emerges in particular from the plan FIG. 1. The angle $\gamma$ is illustrated in FIG. 1 and may be defined as the angle formed between the side 14*a* of the products and a line perpendicular to the conveying direction C. The angle $\gamma$ may also be defined as the angle between the side 14*b* of the products and the conveying direction, which is equivalent to the former definition. This slanting of the stack space 12 with respect to the conveying direction C of the removal conveyor 24 is in fact chosen such that the mentioned angle $\gamma$ is greater than approximately 15°. The stack space 12 is preferably slanted in such a way that this angle $\gamma$ lies between approximately 30° and 60° and in particular between about 30° and 45°.

As FIGS. 1, 2 and 4 show, the printing products 14 are deposited overlapping one another on the removal conveyor 24 and are led away by the latter in an imbricated formation S in which the one corner 25 of the printing products 14 leads. As clearly emerges from FIG. 1, in this led-away imbricated formation S two corners 26 and 27, which are at the sides of the imbricated formation S, lie completely free. Furthermore, the folded edge 14*a* and one side edge 14*b* are completely accessible and the other side edge 14*c*, as well as the open side 14*d*, are only partially accessible. With each printing product 14, an L-shaped region 28 is not covered by the next printing product 14 lying above. This region 28 is thus likewise accessible.

This is in contrast to the already mentioned apparatus according to Swiss Patent Specification 598,106 (or the corresponding U.S. Pat. No. 4,127,262), in which the printing products detached from the stack are led away in an imbricated formation in which the leading edge of the printing products runs at right angles to the conveying direction of the removal conveyor and in which all corners of the printing products either rest on the preceding printing product or are covered by the subsequent printing product.

Since, as mentioned, the two corners 26 and 27 of each printing product 14 which lie to the sides of the imbricated formation S are not in contact with another printing product, in the region of these corners 26, 27 it is possible to act without difficulty on the printing products 14 individually. Thus, it is possible for example to take up individual products 14 manually or with mechanical means in the region of the corner 27 at a removal station 29, shown only schematically (FIG. 1), arranged along the removal conveyor 24 and to draw them in the direction of the arrow D laterally out of the imbricated formation S. In this way, individual printing products 14 can be removed very easily from the imbricated formation S as is shown in FIG. 1 by the printing product 14''' represented by broken lines. Since the region 28 of each printing product 14 not covered by the subsequent printing product 14 is relatively large, the printing product 14 to be removed from the imbricated formation S can be easily identified optically in the combined imbricated formation. This makes it possible to segregate certain printing products 14 from the imbricated formation S manually or by machine without any problems.

The depositing of the printing products 14 detached from the stack 13 in the imbricated formation S shown in FIG. 1 has the further advantage that the height H of the imbricated formation is relatively low in the region of the corner 12*a* of the stack space 12 (see FIG. 4). This makes it possible to arrange the removal conveyor 24 comparatively close to the underside 13*a* of the stack, so that the drop height of the detached printing products 14 is minimized.

Figure 3:
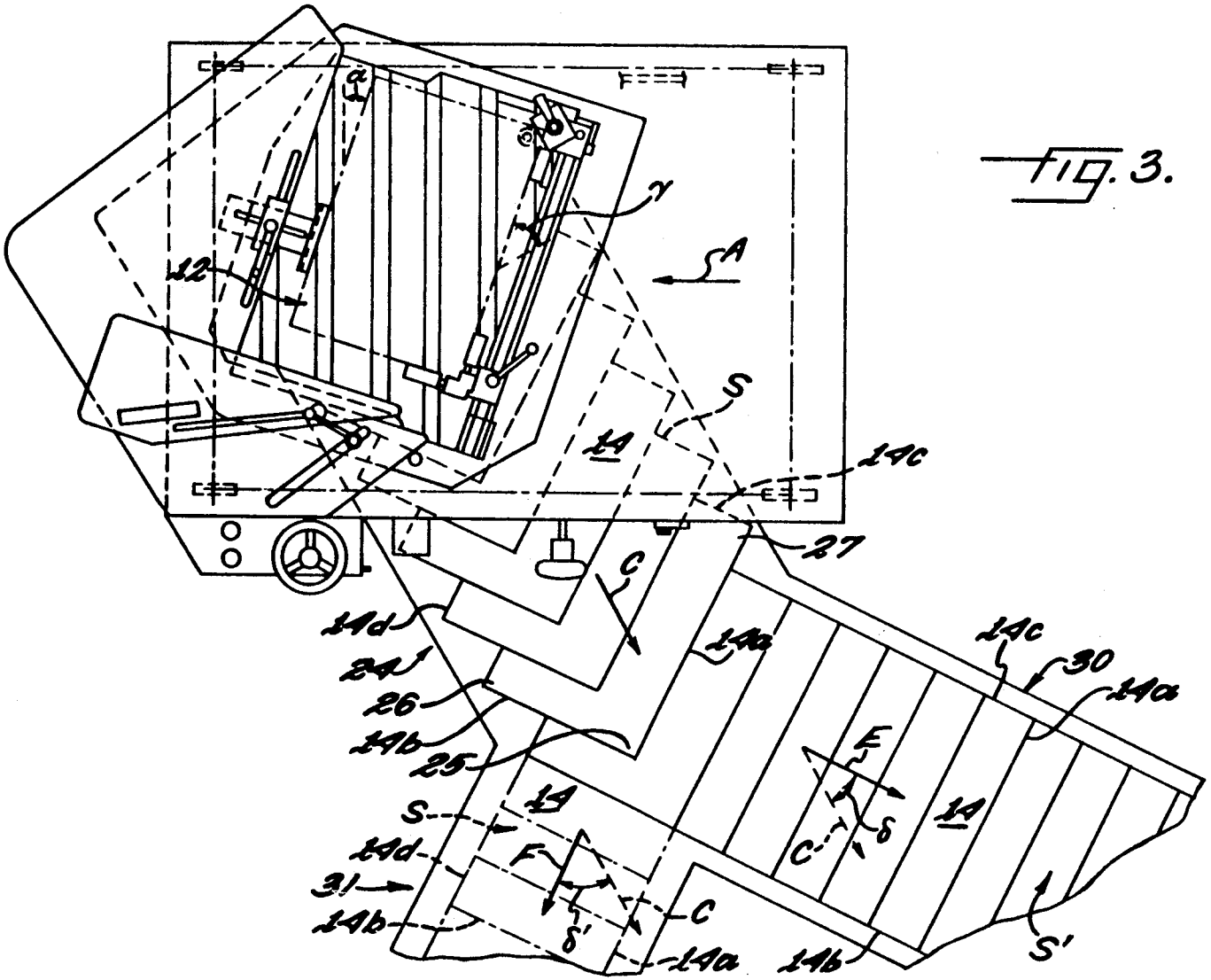
FIG. 3 shows a variant of an apparatus according to the invention in a representation according to FIG. 1.

In FIG. 3, a variant of the apparatus according to the invention in which the detaching of the printing products from the stack 13 and the depositing of the printing products 14 onto the removal conveyor 24 in an imbricated formation S takes place in the same way as explained with reference to FIG. 1 is shown in a representation corresponding to FIG. 1. Due to this identity between the embodiments according to FIGS. 1 and 3, not all reference numerals have been entered in the latter.

The embodiment according to FIG. 3 differs from that according to FIG. 1 in that the removal conveyor 24 is followed downstream by a further removal conveyor 30 and/or 31. The removal conveyors 30, 31 have a conveying direction E and F, respectively, which forms an angle $\delta$ and $\delta'$, respectively, with the conveying direction C of the first removal conveyor 24. The conveying direction E or F of the downstream removal conveyor 30, 31 with respect to the conveying direction C of the first removal conveyor 24 is chosen such that the printing products 14 assume a position in the imbricated formation S' led away by these downstream removal conveyors 30, 31 in which the leading edges 14*a* and 14*b*, respectively, are at right angles to the conveying direction E or F, respectively, of the removal conveyors 30 and 31, respectively. Consequently, it is easy to form from the imbricated formation S conveyed by the removal conveyor 24 a "normal" imbricated formation S', as is frequently required for a further processing. It must also be pointed out that in the imbricated formation S' led away by the removal conveyor 30 the leading edge of the printing products 14 is formed by the folded edge 14*a*, while in the imbricated formation S', which is led away by the other removal conveyor 31, the leading edge is formed by the side edge 14*b*.

In the case of both the embodiments shown, the removal conveyor 24 is arranged in such a way that the printing products 14 are led away with the corner 25 leading. However, it is suite possible to arrange the removal conveyor 24 with a conveying direction opposite to the conveying direction C, so that the printing products are led away with their corner lying opposite the corner 25 leading and with the open side 14*d* ahead.

In addition, it would also be possible to turn the removal conveyor 24 through 90° with respect to the position shown in FIGS. 1 and 3, in order in this way to be able to lead away the printing products 14 with the corners 26 or 27 leading. Design modifications from the embodiments shown must, however, be made to the circulation of the dividing rollers in this variant.

I claim:

1. A process for further processing a stack of preferably folded printing products which is supported on a stack rest, in which successively what is in each case the lowermost printing product in the stack is engaged in the region of a corner, with this corner region being moved downwardly and subsequently detached from the stack by a dividing element, which in the downwardly moved corner region enters between the printing products lying one above the other and is moved in a direction running transversely to the side edges of the stack along the base area of the latter, and the printing products thus successively detached from the stack are deposited, overlapping one another, onto a removal conveyor arranged underneath the stack and below the stack rest and are carried away by the latter in an imbricated formation, wherein the printing products (14) are laid, with all of the side edges (14*a*–14*d*) running transversely to the conveying direction (C) of the removal conveyor (24), onto the previously detached printing product (14) and are led away with one corner (25) leading.

2. The process as claimed in claim 1, wherein, during detaching from the stack (13), the printing products (14) are engaged in the region of a corner (27), which becomes a trailing corner in the imbricated formation (S) led away.

3. The process as claimed in claim 1, wherein, in the imbricated formation (S) led away, individual printing products (14''') are acted upon in their region (28) not covered by the printing product (14) lying above.

4. The process as claimed in claim 3, wherein the region of one of the two exposed corners (26, 27), lying at the sides in the imbricated formation (S) led away, of individual printing products (14''') is acted upon.

5. The process as claimed in claim 4, wherein individual printing products (14''') are taken up in the region of one of the exposed corners (27) and are drawn laterally out of the imbricated formation (S).

6. An apparatus for further processing a stack of preferably folded printing products, comprising a stack rest, which is formed by roller-shaped dividing elements arranged at intervals from one another and driven in a circulating member along a closed path, a right parallelepipedal stack space, which is positioned above the stack rest and is slanted with one of its corners facing toward the direction of movement of the dividing elements, a drivable separating element, which is arranged underneath the stack rest and can be moved periodically between two neighboring dividing elements for engaging and drawing through the region of the corner of the respectively lowermost printing product which faces against the direction of movement of the dividing elements, a continuously drivable removal conveyor, which is arranged below the stack rest and the conveying direction of which forms an angle with the direction of movement of the dividing elements, and onto which conveyor the printing products successively detached from the stack are adapted to be deposited in an overlapping arrangement, and wherein the stack space (12) is slanted, with one of its corners (12*b*) facing the conveying direction (C) of the removal conveyor (24) such that the printing products (14) detached from the stack (13) come to rest with all of the side edges (14*a*–14*d*) running transversely to the conveying direction (C) of the removal conveyor (24) and with one corner (25) facing in the conveying direction (C) of the removal conveyor (24), on the removal conveyor (24) or on the printing product (14) previously deposited thereon.

7. The apparatus as claimed in claim 6, further comprising a work station (29) which is positioned along the removal conveyor (24) and at which individual printing products (14''') are acted upon in their region (28) not covered by the printing product (14) lying above.

8. The apparatus as claimed in claim 7, wherein the work station comprises a removal station (29), at which individual printing products (14''') are engaged in the region of one of the two exposed corners (26, 27), lying at the sides in the imbricated formation (S), and are drawn laterally out of the imbricated formation (S).

9. The apparatus as claimed in claim 6 wherein a first corner (12*a*) of the stack faces against the direction of movement (A) of the dividing elements, and a second corner (12*b*) faces in the conveying direction (C) of the removal conveyor, with the first and second corners being adjacent to each other, and with the side (14*a*) of the products extending between the first and second corners forming an angle ($\gamma$) of at least about 15° with a line perpendicular to the conveying direction (C) of the removal conveyor.

10. The apparatus as claimed in claim 6 wherein the angle ($\gamma$) is between about 30° and 60°.

11. The apparatus as claimed in claim 6, wherein the first removal conveyor (24) is followed downstream by a second removal conveyor (30, 31), the conveying direction (E, F) of which forms with the conveying direction (C) of the first removal conveyor (24) such an angle ($\delta$, $\delta'$) that, in the imbricated formation (S') led away by the second removal conveyor (30, 31), the leading edges (14*a*, 14*b*) of the printing products (14) in each case form a right angle with the conveying direction (E, F) of the second removal conveyor (30, 31).

* * * * *

UNITED STATES PATENT AND TRADEMARK OFFICE

CERTIFICATE OF CORRECTION

PATENT NO. : 5,106,070

DATED : April 21, 1992

INVENTOR(S) : Walter Reist

It is certified that error appears in the above-identified patent and that said Letters Patent is hereby corrected as shown below:

Column 4, line 11, "Y" should be -- τ --.

Column 6, line 46, "member" should be -- manner --.

Column 6, line 67, after "facing" insert -- in --.

Signed and Sealed this

Nineteenth Day of October, 1993

Attest:

Bruce Lehman

BRUCE LEHMAN

Attesting Officer

Commissioner of Patents and Trademarks